United States Patent [19]

Daigle

[11] Patent Number: 4,892,302

[45] Date of Patent: Jan. 9, 1990

[54] JUMPING SKILL TRAINING GAME

[76] Inventor: Dennis L. Daigle, 1004 - 155th St., West, Burnsville, Minn. 55337

[21] Appl. No.: 281,794

[22] Filed: Dec. 9, 1988

[51] Int. Cl.[4] ..... A63B 5/22; A63B 67/00; A63K 3/04

[52] U.S. Cl. ..... 272/74; 273/55 R; 272/101

[58] Field of Search ..... 272/74, 93, 100, 70, 272/101, 136, 102, 103; 273/55 R, 1 R, 1 G, 1 GA; 119/29; 256/1, 14, 22, 59; 434/247, 255

[56] References Cited

U.S. PATENT DOCUMENTS

| | | | |
|---|---|---|---|
| 2,354,050 | 7/1944 | Paupa | 273/55 R |
| 2,685,140 | 8/1954 | Nedwick | 35/29 |
| 3,433,480 | 3/1969 | Coleman et al. | 273/55 |
| 3,536,327 | 10/1970 | Kaehne | 272/100 |
| 4,059,268 | 11/1977 | Forrest | 273/55 R |
| 4,108,435 | 8/1978 | Coleman | 273/55 R |
| 4,134,586 | 1/1979 | King | 273/55 R |
| 4,241,914 | 12/1980 | Bushnell | 272/900 |
| 4,598,906 | 7/1986 | Sansbury | 272/101 |
| 4,793,288 | 12/1988 | Hoadley | 272/101 |

*Primary Examiner*—Stephen R. Crow
*Attorney, Agent, or Firm*—Paul L. Sjoquist

[57] ABSTRACT

An agility skill game usable for exercise or competitive games comprising a pair of spaced-apart facing frames, each said frame having a multiplicity of retainers regularly disposed thereon and at least one elastic cord movably extendable from the retainers of the first frame to the retainers of the second frame. The cord retainers are disposed upon the frame, typically in a regular array such that the cords may be placed upon differing retainers on the same crossbar to change the lateral spacing between the cords and also to change the distance of said cord from a playing surface.

6 Claims, 1 Drawing Sheet

JUMPING SKILL TRAINING GAME

BACKGROUND OF THE INVENTION

The present invention relates generally to devices for recreational use and the like, and more specifically, to an apparatus for providing a competitive challenge while the participants are exercising their legs and developing agility and coordination skills.

A great many skill training devices and the like may be found in the prior art. For example, U.S. Pat. No. 2,354,050, issued July 18, 1944, discloses a runner training apparatus having an elongate grid suspended a fixed distance above the surface. A fixed grid of foot tread areas are disposed a fixed distance above the surface and the device is permanently installed at the one location.

U S. Pat. No. 4,059,268 issued Nov. 22, 1977, to Charles Forrest, U.S. Pat. No. 4,108,435, issued Aug. 22, 1978, to James Coleman, and U.S. Pat. No. 4,134,586, issued Jan. 16, 1979, to James King all disclose similar training grids having a regular grid of foot tread areas, having various improvements, primarily by making the training grid somewhat portable and introducing flexibility into each of the grid members to minimize problems of injury. All of the devices, even the more portable ones, contemplate the user running through the grid from the one end to the other end, emphasizing the coordination of leg-eye skills and exemplifying the use as a training aid for football players.

SUMMARY OF THE INVENTION

The invention comprises a pair of frames preferably disposed in a spaced-apart manner, having elastic cords extending between and retained on each of the frames. Each frame has a number of cord retainers disposed thereon. The cord retainers are disposed upon the frame, typically in a regular array such that the cords may be placed upon differing retainers on the same crossbar to change the lateral spacing between the cords and thereby the size of the foot tread areas, or the cords may be placed on different crossbars to change their distance from the playing surface.

It is the principal object of the present invention to provide an apparatus which is enjoyable to use while improving both the player's eye-foot coordination and the player's lower body musculature.

It is a further object of the present invention to provide a training aid which can be played as an agility game.

It is a further object of the present invention to provide an apparatus having elastic cords that can be set at varying heights.

It is a further object of the present invention to provide an apparatus having elastic cords setable at varying spacings.

It is still a further object of the present invention to provide an agility training apparatus that can be readily moved, set up, and used by one person.

It is a further object of the present invention to provide an agility training apparatus that can be played indoors or outdoors.

BRIEF DESCRIPTION OF THE DRAWINGS

The foregoing and other objects of the invention will become apparent from the following specification, and with reference to the appended claims and the drawings.

DESCRIPTION OF THE PREFERRED EMBODIMENT

Figure 1:
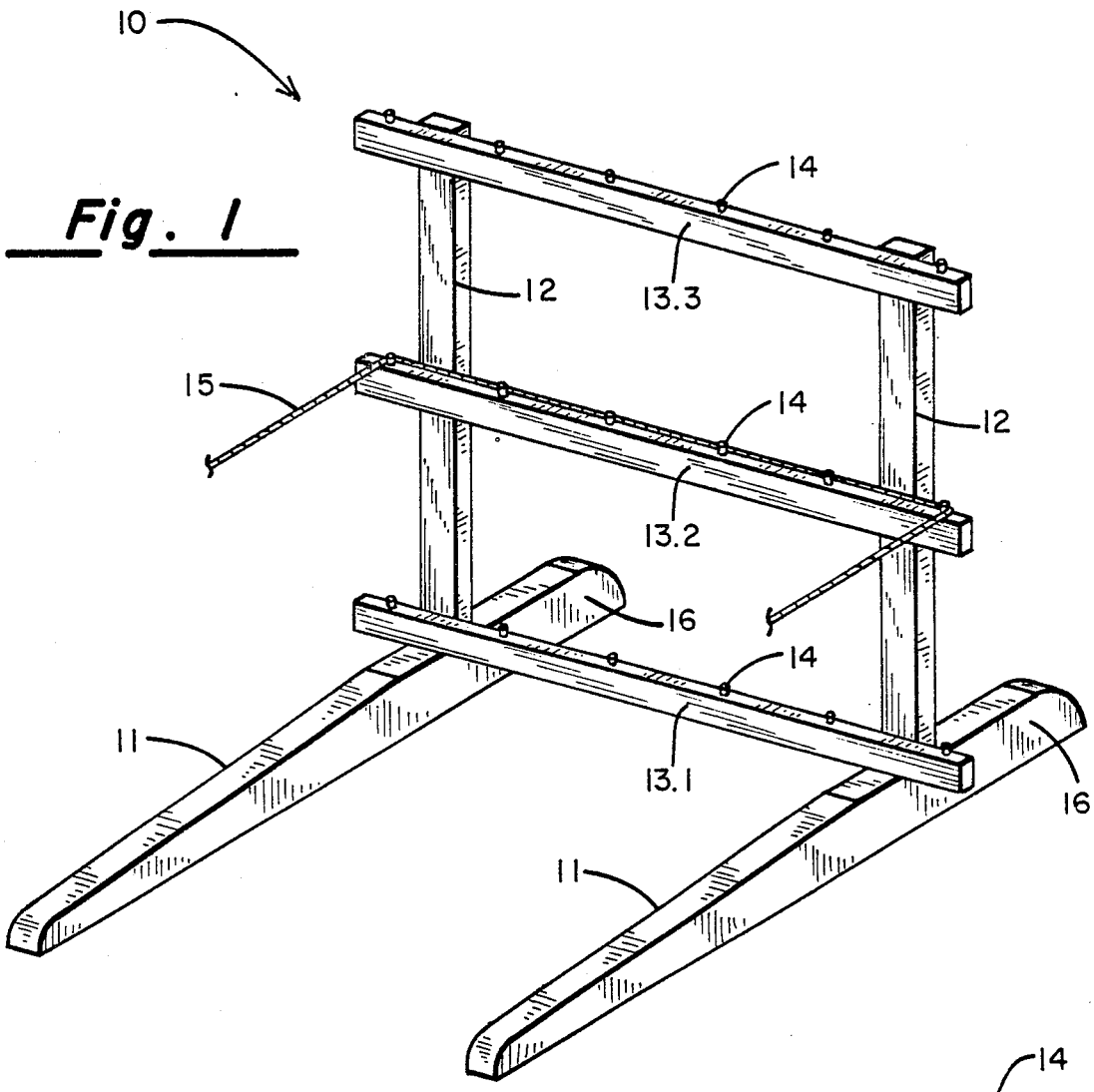
FIG. 1 shows one of the frames of the preferred embodiment of the invention showing elastic cord in one position.
Figure 2:
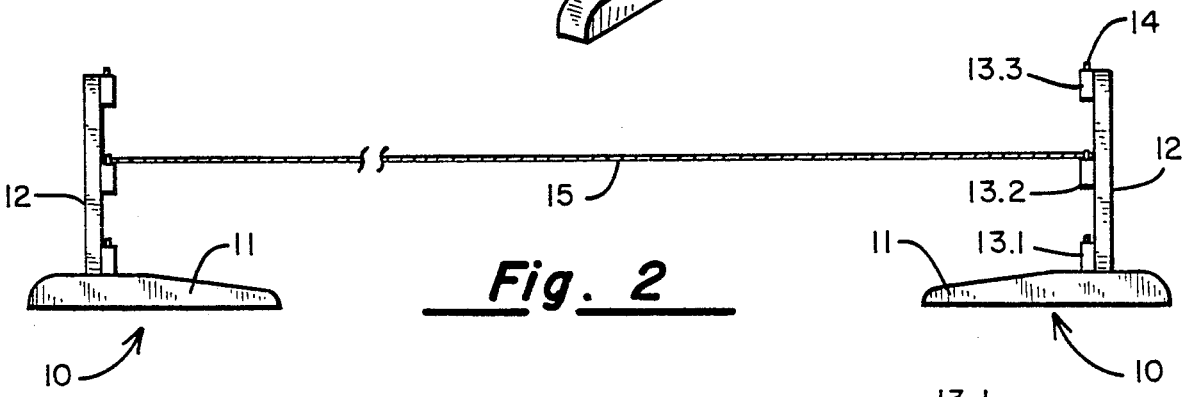
FIG. 2 is a side elevation view of the preferred embodiment showing the elastic cord extending between the two frames.

Referring first to FIG. 1 there is shown a frame 10, rectangular in shape having feet 11, uprights 12, and crossbars 13 and multiple retainers 14 disposed along each crossbar 13. While only one frame 10 is shown in FIG. 1, it is understood that the invention includes two frames 10, as is more clearly shown in FIG. 2. Extending between the frames 10 and extending around several of the retainers 14 of the crossbars 13 is an elastic cord 15.

Each frame 10 may be made from a multitude of materials, such as wood or plastic, and is preferably constructed from injection molded plastic. When the frame 10 is constructed of a lightweight material such as plastic, it is preferably weighted by placing weights 16 in the end of each foot 11. The weights 16 may be of any suitable substance which is typically inexpensive and has a high weight-to-volume ratio For example, foot 11 could be made from plastic having a hollow interior, and the interior could be filled with sand or water. A friction pad 17 is preferably placed on the bottom of each foot. The friction pad 17 is typically a rubber or cloth-like adhesion substance extending along each foot and attached hereto The friction pad 17 material is chosen to increase the sliding friction of each frame 10 along a smooth surface such as tile floor. Additionally, the friction pad 17 is soft so that it protects the surface from damage caused by sliding of the feet 11 of the frame 10 therealong.

Extending upwardly from each foot 11 is an upright 12. Each upright 12 is suitably dimensioned to provide rigidity and to extend upwardly a sufficient distance to provide for attachment of multiple crossbars 13 at suitable heights. The plurality of crossbars 13, typically three, are attached between the uprights 12 and disposed perpendicularly thereto. Each of the crossbars 13 is disposed at a height to provide an increasing level of difficulty and to exercise different groups of muscles. Disposed along each crossbar 13 are multiple retainers or hooks for retention of the cord 15 thereon.

In the first embodiment of the invention, each retainer 14 is formed from dowel stock or pegs and is attached to each crossbar 13 by placement in a predrilled hole therein. The retainers 14 are retained therein using any suitable means such as friction or glue. This construction is particularly suitable for the use of wood for the crossbars 13.

Figure 3:
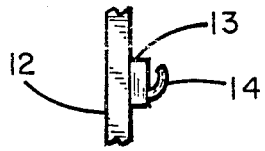
FIG. 3 is a side elevation view showing an alternate construction of the cord retainer hook.
Figure 4:
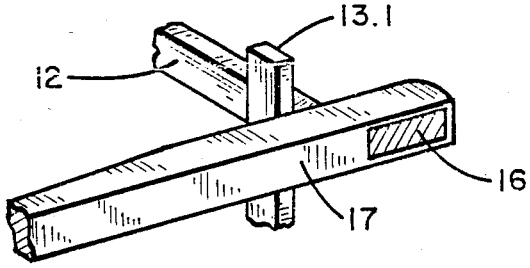
FIG. 4 is a partial cutaway showing a weight and the friction pad in one foot of a frame.

In the second type of construction, shown in FIG. 3, the retainers 14, extend outwardly from the inner surface of the crossbar 13 and extend outwardly therefrom for placement of the cord 15 thereabout. This type of construction is particularly suited for the use of injection-molded plastic where each crossbar 13 is molded with hooks 14 integral thereto in a single process.

While only one elastic cord 15 is shown in the drawings, it is understood that multiple cords may be placed upon the hooks 14 of the crossbars 13 as the skill and agility of the user increases, thereby increasing the difficulty in use of the apparatus. Each cord 15 is formed from an elastic substance having sufficient resilience so as to not sag between the two frames and having sufficient elasticity so as to be displaceable to the playing surface without moving or tipping over the frames 10. The cord 15 may be constructed of any such suitable material and is preferably ⅛inch diameter fabric-coated rubber cord commonly known as a "bungee" cord.

The cord 15 is shown, for convenience, as a continuous loop extending from and about the retainers 14 of the first frame 10 to and around the retainers 14 of the second frame 10. The cord 15, however, may also be a single length attachable to the retainers 14 of the first frame 10 and extending therefrom for attachment to the retainers of the second frame 10.

In the preferred embodiment of the invention, three crossbars 13 are used, referred to as the lower crossbar 13.1, the middle crossbar 13.2 and the upper crossbar 13.3. Disposed along each crossbar 13 and regularly spaced are the retainers 14. This arrangement places the retainers 14 in a regular array, allowing the cord 15 to be readily moved in either a horizontal direction, by selecting the adjacent retainer 14 on the same crossbar 13, or in a vertical direction by selecting the same retainer 14 upon a different crossbar 13.

In its use, each of the frames 10 is placed on the playing surface facing the other frame 10 and spaced a suitable distance apart. The playing surface may be indoors on a smooth floor or may be outdoors on a substantially level surface. The user then takes at least one cord and extends it between the selected retainers 14 on the first frame and the selected retainers 14 on the second frame. By selecting the spacing between multiple cords 15, the user may vary the level of difficulty by varying the size allowed for each foot tread area between the cords 15. The difficulty level may be further varied by moving the cords 15 from the lower crossbar 13.1 to the middle crossbar 13.2, and ultimately to the uppermost crossbar 13.3.

Having placed the cords in suitable locations, the user may then use the apparatus by either stepping over the cords or jumping over the cords, the object being to be able to repeatedly move one's feet over the cords and placed in between the cords without touching the cords. Such exercise then improves the user's foot-eye coordination and improves his or her ability to move and more particularly to run while rapidly changing direction. As the skill of the user progresses, the cords 15 may be spaced closer together therefore requiring the user to have more precise foot placement with each step or the cords 15 may be moved to a higher level; for example, from a lower crossbar 13.1 to middle crossbar 13.2, thereby requiring that the user lift each leg higher on each footstep which will generally increase the difficulty of performance while increasing the exercise potential and leg lift.

In an alternate mode of play, the user jumps, using both feet, from one foot fall area to a second foot fall area. This repeated exercise hones and sharpens different skills while exercising different groups of muscles. Again, the user may vary the degree of difficulty by varying the placement of the cords 15 along each crossbar 13 and increase the difficulty by raising the cord 15, for example, from lower crossbar 13.1 to middle crossbar 13.2.

Thus, the invention provides an apparatus suitable for exercise and development of the lower body in an apparatus which is readily portable and usable both indoors and outdoors. Particularly, the use to the invention will increase eye-foot coordination enhancing the user's walking and running skills, especially on rough terrain or where the user must avoid obstacles or rapidly change directions.

Furthermore, the apparatus allows multiple persons to use it devising their own competitive games limited only by each user's imagination. For example, a variety of games can be constructed wherein the object of the game is to be able to run, step or jump over the cords 15 at the greatest speed. A second group of competitive games could be constructed where the winning goal is the greatest number of repetitions without touching a cord. A third group of games could be constructed wherein the winning goal of playing would be repetition of a complex formula of foot placement requiring the user to perform this complex pattern repetitively without error with bonus given for one's speed. As in exercising, the difficulty of the games can be changed by the spacing of the cords 15 along the retainers 14 and the vertical placement of the cords 15.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A skill training game, comprising (a) a pair of substantially identical frames adapted for spaced-apart, independently supported positioning, each frame comprising (i) a pair of spaced apart foot members;

(ii) an upwardly projecting post affixed to each foot member;

(iii) a plurality of spaced-apart crossing members bridging between said posts, each crossing member having a plurality of regularly spaced retainers;

(b) an elongate elastic cord adapted for connection about one or more retainers and for extending between said frames whereby said retainers align said cord in parallel segments and said parallel segments provide obstacles for jumping, and wherein the lateral spacing between the parallel segments and the distance of said segments from a support surface may be changed.

2. The apparatus of claim 1, wherein each of said foot members includes a bottom friction surface for contacting a support surface.

3. The apparatus of claim 1, wherein each of said foot members further comprise a weighted section.

4. The apparatus of claim 1, wherein said retainers further comprise projecting pins.

5. The apparatus of claim 1, wherein said retainers further comprise hooked members.

6. A skill game apparatus for placement upon a surface, comprising a pair of frames disposed spaced apart and facing along said surface, each said frame comprising (i) a pair of feet, each foot extending from the frame, toward and away from the facing frame;

(ii) a pair of uprights extending orthogonally from the surface and each upright attached to a foot;

(iii) three crossbars disposed parallel to each other, each crossbar affixed perpendicularly near each end to an upright, the first crossbar further disposed adjacent and perpendicular to each foot; the second crossbar located a fixed distance above the first crossbar and the third crossbar located the fixed distance from the second crossbar; each said crossbar having a plurality of projecting pins affixed therealong, each pin further being spaced a fixed distance from an adjacent pin;

(iv) an elastic cord extendable around at least one pin on a crossbar of the first frame, and further extendable to and around at least one pin on a crossbar of the second frame, whereby the lateral spacing between the parallel segments and the distance of said segments from a support surface may be changed.

* * * * *